US007080999B2

(12) United States Patent
Narui et al.

(10) Patent No.: US 7,080,999 B2
(45) Date of Patent: Jul. 25, 2006

(54) DIRECT-MOUNTING CONNECTOR-FITTING STRUCTURE

(75) Inventors: Fumio Narui, Yokohama (JP); Shinichi Ikemoto, Yokohama (JP)

(73) Assignees: Yazaki Corporation, Tokyo (JP); Yazaki Syscomplus Co., Ltd., Kanagawa (JP)

( * ) Notice: Subject to any disclaimer, the term of this patent is extended or adjusted under 35 U.S.C. 154(b) by 0 days.

(21) Appl. No.: 11/168,995

(22) Filed: Jun. 29, 2005

(65) Prior Publication Data

US 2006/0003616 A1 Jan. 5, 2006

(30) Foreign Application Priority Data

Jun. 29, 2004 (JP) ..... P2004-191097

(51) Int. Cl.
*H01R 13/64* (2006.01)

(52) U.S. Cl. ..... 439/246

(58) Field of Classification Search ..... 439/246, 439/247, 248, 252, 74
See application file for complete search history.

(56) References Cited

U.S. PATENT DOCUMENTS 3,864,000 A * 2/1975 Coller et al. ..... 439/246
5,921,787 A * 7/1999 Pope et al. ..... 439/74

FOREIGN PATENT DOCUMENTS

JP 8-250240 A 9/1996
JP 2002-158070 A 5/2002

* cited by examiner

*Primary Examiner*—Phuong Dinh
(74) *Attorney, Agent, or Firm*—Sughrue Mion, PLLC

(57) ABSTRACT

Deflection spaces for allowing the deflection of male terminals are formed respectively in those portions of a connector housing of a male connector disposed near respectively to proximal end portions of the male terminals. A thinned portion is formed at that portion of each male terminal (of the male connector) disposed in the deflection space, and this thinned portion is smaller in thickness than its connection portion for connection to a female terminal. During the fitting of the connectors, the thinned portions of the male terminals are deflected within the deflection spaces, and therefore strains of various portions of the connectors, developing during the fitting of the connectors due to a positional error and a mounting error of upper and lower printed circuit boards, can be absorbed.

5 Claims, 11 Drawing Sheets

DIRECT-MOUNTING CONNECTOR-FITTING STRUCTURE

BACKGROUND OF THE INVENTION

This invention relates to a direct-mounting connector-fitting structure in which at least one of a pair of connectors is fixed to a board.

There is already known a direct-mounting connector which is fixed to a board (see, for example, Patent Literatures 1 and 2). FIG. 16 is an exploded, perspective view of a direct-mounting connector disclosed in Patent Literature 1, FIG. 17 is a cross-sectional view of an important portion of the direct-mounting connector of FIG. 16, and FIG. 18 is a cross-sectional view of an important portion, showing a condition in which the direct-mounting connector of FIG. 16 is mounted on a board, and is disposed in a connected condition. FIG. 19 is a cross-sectional view of an important portion of a printed circuit board connection structure disclosed in Patent Literature 2.

As shown in FIGS. 16 to 18, a connector body 101 of the electric connector 100 comprises one end-side member 102, and the other end-side member 103. First terminal holding portions 105 are provided at the one end-side member 102, and one end portions of terminals 110 are press-fitted respectively into the first terminal holding portions 105 from the other end side of the connector body 101. Second terminal holding portions 104 are provided at the other end-side member 103, and the other end portions of the terminals 110 are press-fitted respectively into the second terminal holding portions 104 from the one end-side of the connector body 101. The other end portions of the terminals 110 are soldered to one board 120, and in this condition the electric connector 100 is connected to a mating connector 130 mounted on another board 121.

In this electric connector 100, the terminals 110 are firmly held in the connector body 101 against movement in a direction of inserting and withdrawing of mating terminals 131 of the mating connector 130. Therefore, a force, applied from the terminals 110 to the boards 120 and 121 when inserting and withdrawing of the mating terminals 131, is reduced.

The printed circuit board connection structure, shown in FIG. 19, is used to connect two printed circuit boards 140 and 141 together. A header 150, provided at one printed circuit board 140, is joined to a socket 151 provided at the other printed circuit board 141, thereby connecting the two printed circuit boards 140 and 141 together.

Namely, the header 150 is provided in an insertion hole 142 formed through the one printed circuit board 140. The header 150 includes posts 152 having terminal plates 153 projecting from the header 150. The terminal plates 153 are mounted on an outer surface of the one printed circuit board 140 facing away from the other printed circuit board 141.

The socket 151 is provided on an outer surface of the other printed circuit board 141, and contains contacts 154. Terminal plates 155 of the contacts 154 project from the socket 151, and are mounted on the other printed circuit board 141. Patent Literature 1: JP-A-2002-158070 (FIGS. 3 and 4) Patent Literature 2: JP-A-8-250240

However, each of the above related electric connector 100 (shown in FIGS. 16 to 18) and the above related printed circuit board connection structure (shown in FIG. 19) is not provided with any structure for absorbing a positional error and a mounting error of the boards 120 and 121, 140 and 141 during the fitting of the connectors. Therefore, there has been encountered a problem that strains of various portions of the connector due to the positional error and a mounting error of the boards 120 and 121, 140 and 141 inevitably develop during the fitting of the connector.

The development of the strains in the various portions of the connector adversely affects the displacement of the female terminals (which is effected when the female terminals are connected to the male terminals), and also adversely affects the connected condition of the male and female terminals. And besides, the connector housing is deflected, and also stresses act on the soldered portions, and this has invited a problem that the durability of the connector is lowered.

SUMMARY OF THE INVENTION

This invention has been made in view of the above circumstances, and an object of the invention is to provide a direct-mounting connector-fitting structure in which strains of various portions of connectors, developing during the fitting of the connectors due to a positional error and a mounting error of boards can be absorbed, thereby securing a positive connector-fitting performance and enhanced durability of the connectors.

In order to accomplish of the above object, a direct-mounting connector-fitting structure of the present invention is characterized by the following.

A connector having a connector housing formed with side walls defining a cavity having a bottom portion; and a terminal provided in the connector housing and having a first terminal portion projecting to the cavity and a second terminal portion continued from the first terminal portion. The bottom portion is formed with a first deflection space communicating with the cavity, and the first deflection space surrounds a part of the second terminal portion with a gap.

The connector further has a board member on which the connector housing is mounted.

The part of the second terminal portion includes a third terminal portion that is lower in stiffness than the first terminal portion.

The third terminal portion is smaller in thickness than the first terminal portion.

At least a part of the cavity is formed by a through hole formed in a board member, and the first terminal portion passes through the through hole and is coupled with a mating terminal provided in a mating connector, so that the through hole serves as a second deflection space surrounding a part of the first terminal portion with a gap.

Further, the mating connector is mounted on the board member.

According to the invention, during the fitting of the connectors, the male terminals are deflected within the deflection spaces (provided near to the proximal end portions of the male terminals) for allowing the deflection of the male terminals, and therefore strains of various portions of the connectors, developing during the fitting of the connectors due to a positional error and a mounting error of the board, can be absorbed. As a result, the positive connector-fitting performance and the enhanced durability of the connector can be secured.

According to the invention, during the fitting of the connectors, the male terminals are deflected within the deflection spaces (provided near to the proximal end portions of the male terminals and also in the through holes in the board) for allowing the deflection of the male terminals, and therefore strains of various portions of the connectors, developing during the fitting of the connectors due to a positional error and a mounting error of the board, can be absorbed. As a result, the positive connector-fitting performance and the enhanced durability of the connector can be secured.

According to the invention, during the fitting of the female connector into the connector fitting portion of the male connector, the male terminals are deflected within the deflection spaces (provided near to the proximal end portions of the male terminals) for allowing the deflection of the male terminals, and therefore strains of various portions of the connectors, developing during the fitting of the connectors due to a positional error and a mounting error of the board, can be absorbed. As a result, the positive connector-fitting performance and the enhanced durability of the connector can be secured.

According to the invention, during the time when the male terminals are connected respectively to the female terminals via the respective through holes formed through the board in the connector-fitting operation, the male terminals are deflected within the deflection spaces (provided near to the proximal end portions of the male terminals and also in the through holes in the board) for allowing the deflection of the male terminals, and therefore strains of various portions of the connectors, developing during the fitting of the connectors due to a positional error and a mounting error of the board, can be absorbed. As a result, the positive connector-fitting performance and the enhanced durability of the connector can be secured.

According to the invention, the deflection function is provided at that portion of each of the male terminals which is disposed in the deflection space, and therefore during the fitting of the connectors, the male terminal can be positively deflected within the deflection space. Therefore, strains of the various portions of the connectors, developing during the fitting of the connectors due to a positional error and a mounting error of the board, can be more positively absorbed.

According to the invention, the deflection function of the male terminal is secured by the thinned portion of the male terminal which is smaller in thickness than the connection portion of the male terminal for connection to the female terminal. Therefore, during the fitting of the connectors, the male terminal can be positively deflected within the deflection space. Therefore, strains of the various portions of the connectors, developing during the fitting of the connectors due to a positional error and a mounting error of the board, can be more positively absorbed at a low cost.

DETAIL DESCRIPTION OF PREFERRED EMBODIMENTS

A first embodiment of a direct-mounting connector fitting-structure of the present invention will now be described.

Figure 1:
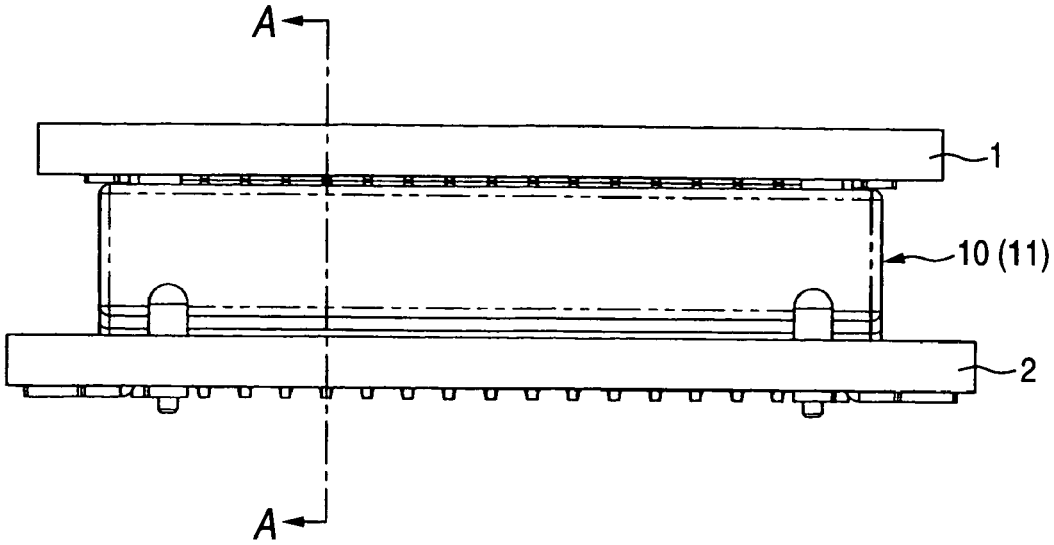
FIG. 1 is a side-elevational view showing a condition in which female and male connectors to which a first embodiment of a direct-mounting connector-fitting structure of the present invention is applied are fitted together.
Figure 2:
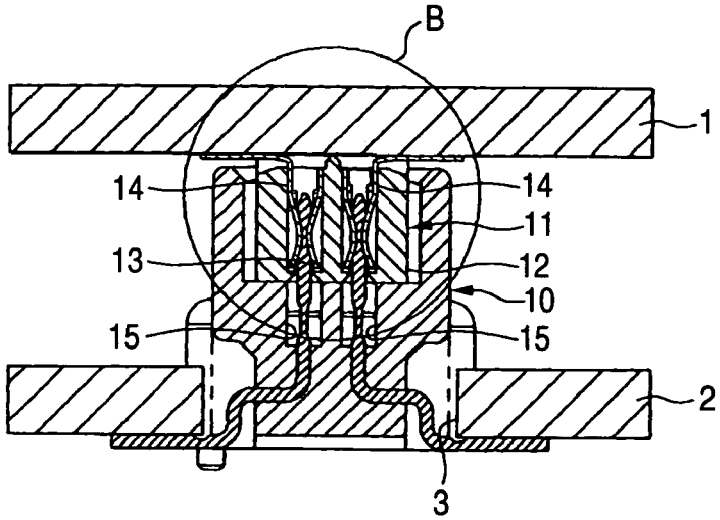
FIG. 2 is a cross-sectional view taken along the line A—A of FIG. 1.
Figure 3:
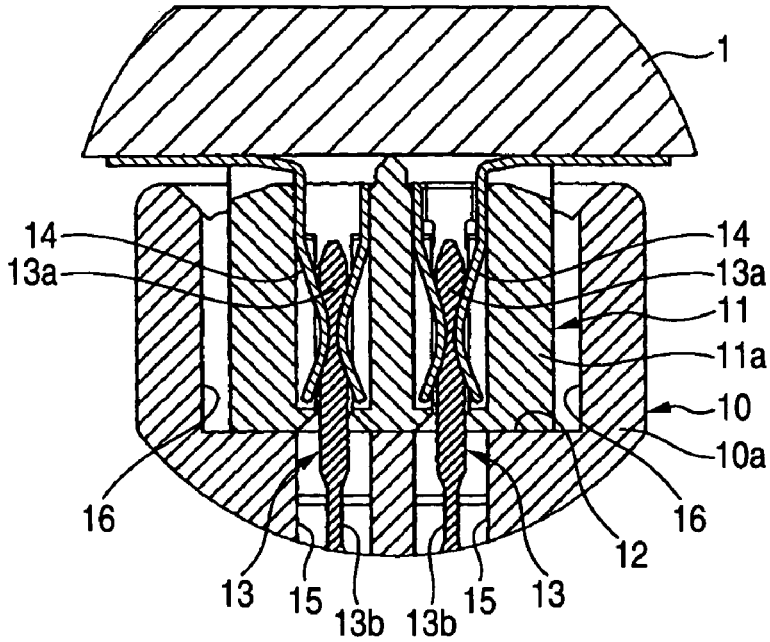
FIG. 3 is an enlarged cross-sectional view of a portion B of FIG. 2.
Figure 4:
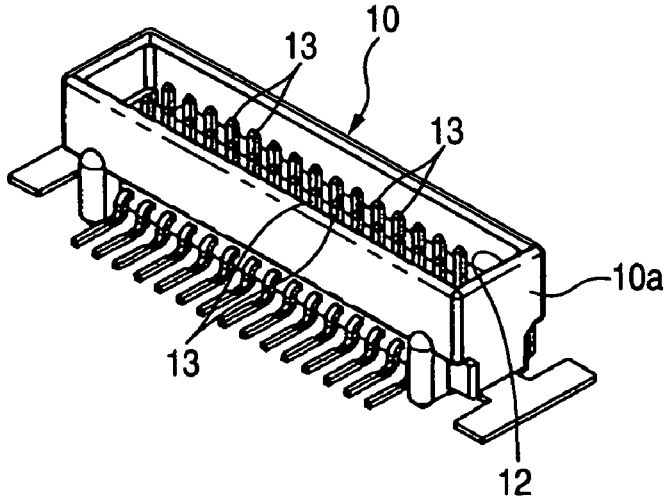
FIG. 4 is a perspective view of the male connector.
Figure 5:
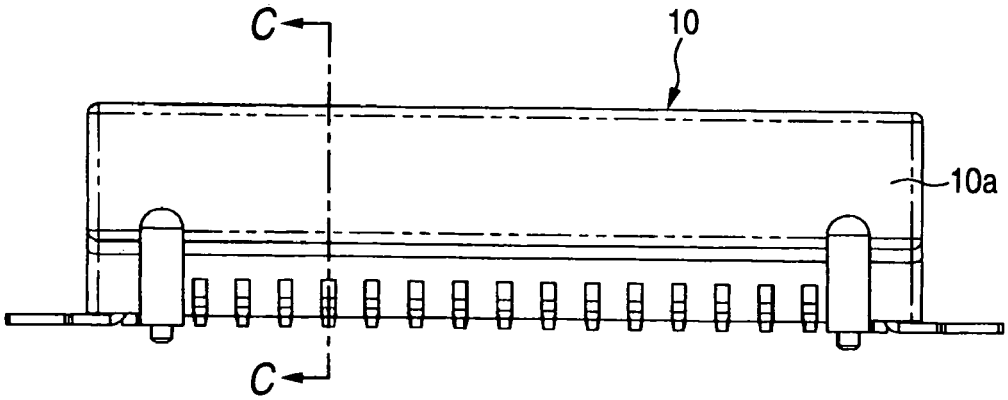
FIG. 5 is a side-elevational view of the male connector of FIG. 4.
Figure 6:
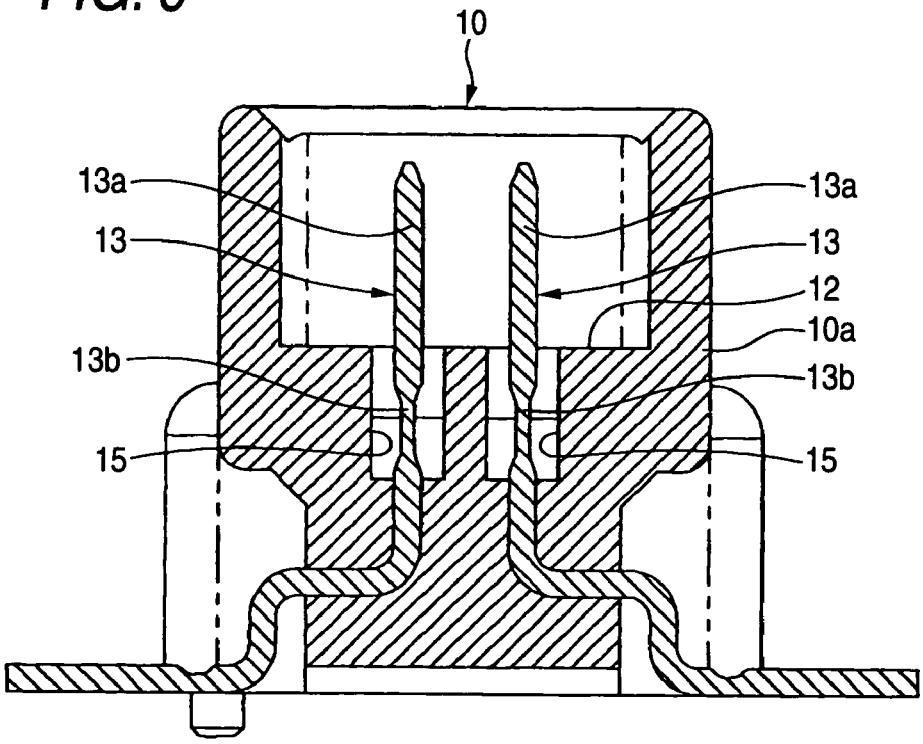
FIG. 6 is a cross-sectional view taken along the line C—C of FIG. 5.
Figure 7:
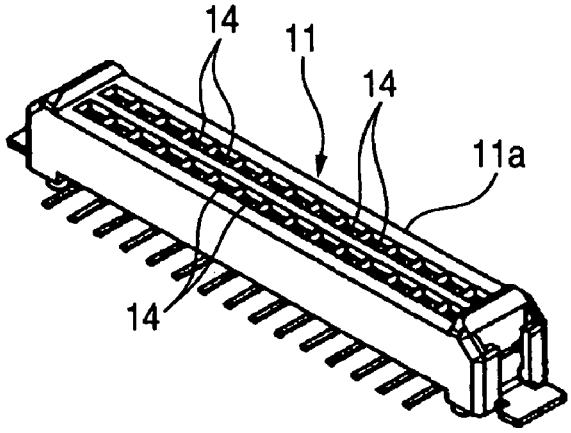
FIG. 7 is a perspective view of the female connector.
Figure 8:
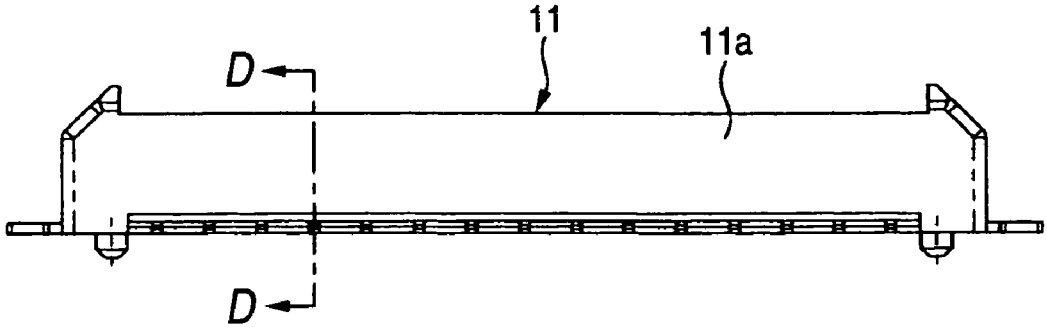
FIG. 8 is a side-elevational view of the female connector of FIG. 7.
Figure 9:
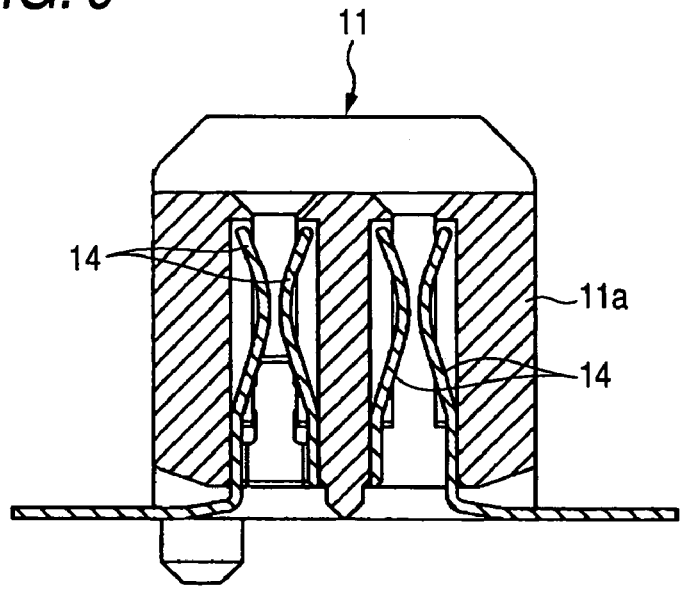
FIG. 9 is a cross-sectional view taken along the line D—D of FIG. 8.

FIG. 1 is a side-elevational view showing a condition in which female and male connectors to which the first embodiment of the direct-mounting connector-fitting structure of the invention is applied are fitted together, FIG. 2 is a cross-sectional view taken along the line A—A of FIG. 1, and FIG. 3 is an enlarged cross-sectional view of a portion B of FIG. 2. FIG. 4 is a perspective view of the male connector, and FIG. 5 is a side-elevational view of the male connector of FIG. 4, and FIG. 6 is a cross-sectional view taken along the line C—C of FIG. 5. FIG. 7 is a perspective view of the female connector, FIG. 8 is a side-elevational view of the female connector of FIG. 7, and FIG. 9 is a cross-sectional view taken along the line D—D of FIG. 8.

Referring to FIGS. 1 to 3, in the direct-mounting connector-fitting structure of the first embodiment, the male connector 10 and the female connector 11 are directly fixed between inner sides of upper and lower printed circuit boards 1 and 2. Male terminals 13 of the male connector 10 are connected respectively to female terminals 14 of the female connector 11, with a connector housing 11*a* of the female connector 11 fitted in a connector fitting portion 12 provided at a connector housing 10*a* of the male connector 10.

Namely, referring to FIGS. 1 to 3 and FIGS. 7 to 9, the female connector 11 is fixed to the lower surface of the upper printed board 1, and a number of female terminals 14 of a generally X-shaped cross-section are provided within the connector housing 11*a* of the female connector 11. The female terminals 14 are joined at their proximal end portions (upper end portions in FIG. 3) to a circuit on the upper printed circuit board 1, and are electrically connected thereto. A free end portion (lower end portion in FIG. 3) of each female terminal 14 remote from its proximal end portion is formed such that even if the male terminal 13, when connected to the female terminal 14, is deflected, this free end portion abuts against a peripheral wall of a terminal receiving chamber in the connector housing 11*a* to secure a necessary contact pressure.

Referring to FIGS. 1 to 6, the male connector 10 is fitted in a mounting hole 3, formed through the lower printed circuit board 2, in such a manner that the connector housing 10 projects upwardly a predetermined amount from the lower printed circuit board 2. A number of male terminals 13 projects into the interior of the connector fitting portion 12 of the connector housing 10*a*. The male terminals 13 are joined at their proximal end portions (lower end portions in FIG. 2) to a circuit on the lower printed circuit board 2, and are electrically connected thereto. When the female connector 11 is fitted into the connector fitting portion 12 of the male connector 10, connection portions (upper portions in FIG. 2) 13*a*, formed respectively at distal ends of the male terminals 13, are connected respectively to the corresponding female terminals 14 of the female connector 11.

As shown in FIGS. 2, 3 and 6, deflection spaces 15 for allowing the deflection of the male terminals 13 are formed respectively in those portions of the connector housing 10*a* of the male connector 10 disposed near respectively to the proximal end portions of the male terminals 13. A thinned portion 13*b* is formed at that portion of each male terminal 13 (of the male connector 10) disposed in the deflection space 15, and this thinned portion 13*b* is smaller in thickness (that is, transverse cross-sectional area) than the connection portion 13*a* for connection to the female terminal 14. The thinned portions 13*b* of the male terminals 13 are deflected within the deflection spaces 15 during the fitting of the connectors, and absorb strains of various portions of the connectors developing during the fitting of the connectors due to a positional error and a mounting error of the upper and lower printed circuit boards 1 and 2.

The male and female connectors 10 and 11 are so formed that when the male and female connectors 10 and 11 are fitted together, a fitting space 16 is formed between each of opposite outer side surfaces of the connector housing 11*a* of the female connector 11 and an inner peripheral surface of the connector fitting portion 12 within the connector housing 10*a* of the male connector 10 as shown in FIG. 3. Thanks to the provision of the fitting spaces 16, the two connector housings 10*a* and 11*a* can be moved laterally slightly relative to each other during the fitting of the connectors, and therefore the connector housings 10*a* and 11*a* of the male and female connectors 10 and 11 can also absorb strains of the various portions of the connectors.

In the direct-mounting connector-fitting structure of this embodiment, the connector housing 11*a* of the female connector 11 is fitted in the connector fitting portion 12 of the male connector 10, with the male terminals 13 of the male connector 10 connected respectively to the corresponding female terminals 14 of the female connector 11.

At this time, in case a positional error and a mounting error have developed in the upper and lower printed circuit boards 1 and 2, the thinned portions 13*b* of the male terminals 13 of the male connector 10 are deflected within the deflection spaces 15 in the connector housing 10*a*. As a result, strains of the various portions of the connectors due to the positional error and a mounting error of the upper and lower printed circuit boards 1 and 2 are absorbed. Therefore, the connector housings 10*a* and 11*a* will not be deflected, and also stresses or the like will not act on the soldered portions.

Next, a second embodiment of a direct-mounting connector-fitting structure of the invention will be described.

Figure 10:
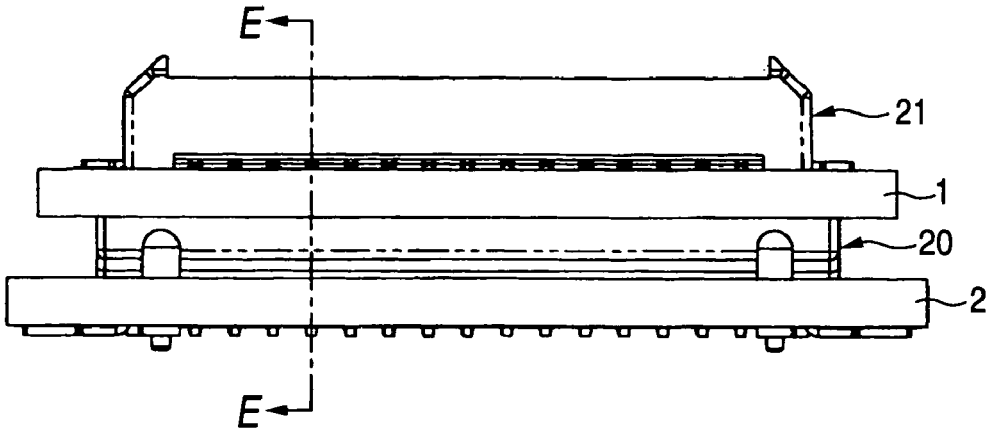
FIG. 10 is a side-elevational view showing a condition in which female and male connectors to which a second embodiment of a direct-mounting connector-fitting structure of the invention is applied are fitted together.
Figure 11:
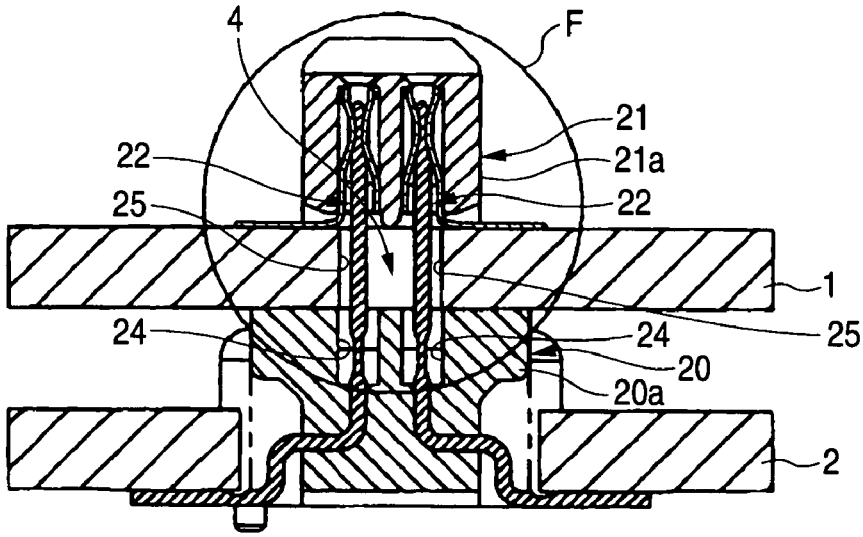
FIG. 11 is a cross-sectional view taken along the line E—E of FIG. 10.
Figure 12:
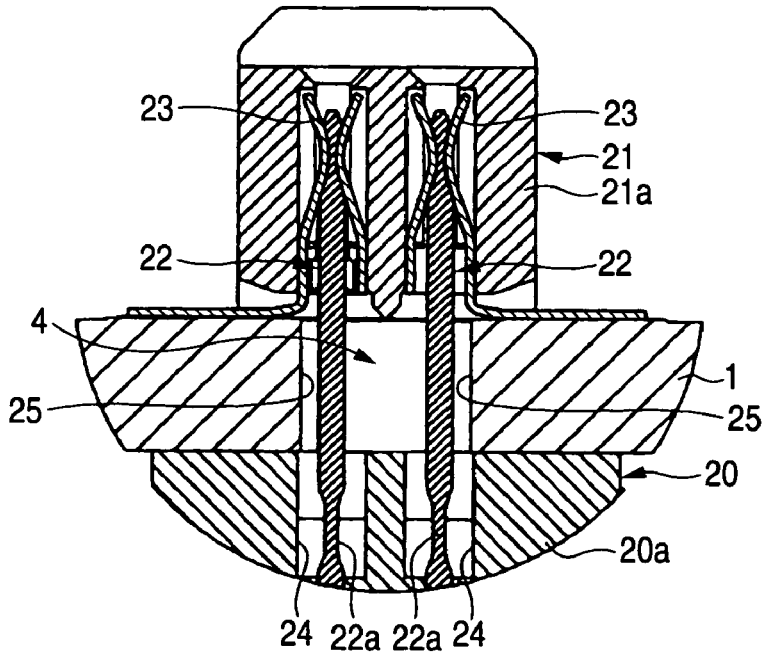
FIG. 12 is an enlarged cross-sectional view of a portion F of FIG. 11.
Figure 13:
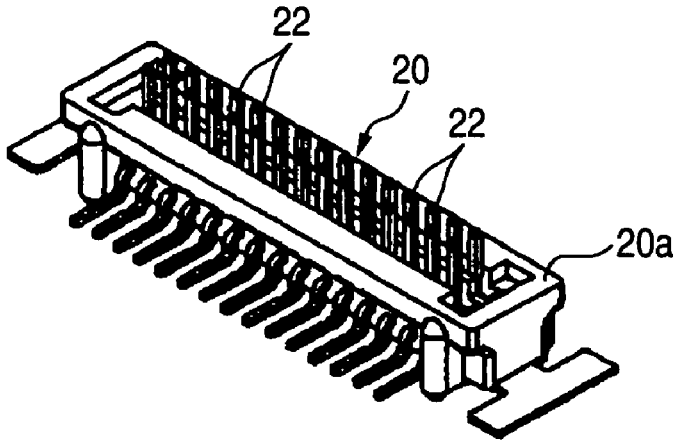
FIG. 13 is a perspective view of the male connector.
Figure 14:
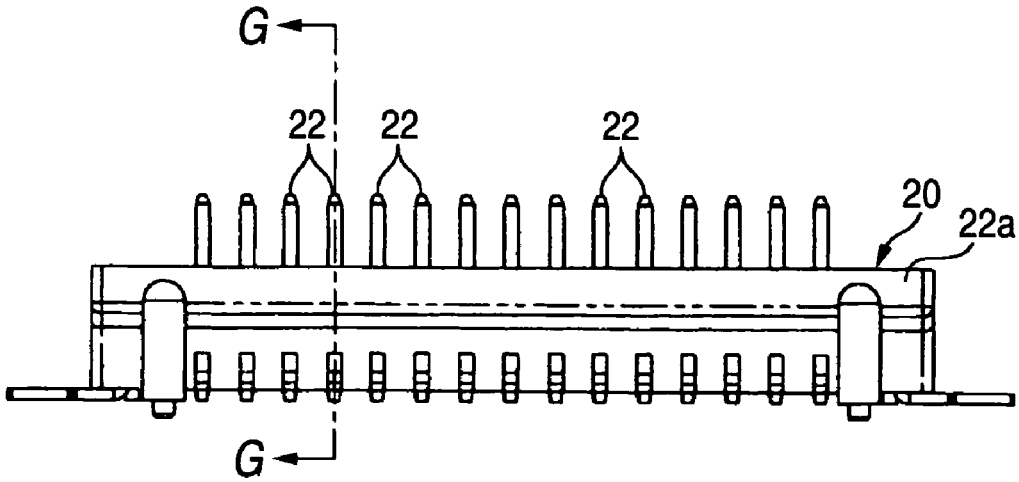
FIG. 14 is a side-elevational view of the male connector of FIG. 13.

FIG. 10 is a side-elevational view showing a condition in which female and male connectors to which the second embodiment of the direct-mounting connector-fitting structure of the invention is applied are fitted together, FIG. 11 is a cross-sectional view taken along the line E—E of FIG. 10, and FIG. 12 is an enlarged cross-sectional view of a portion F of FIG. 11. FIG. 13 is a perspective view of the male connector, and FIG. 14 is a side-elevational view of the male connector of FIG. 13, and FIG. 15 is a cross-sectional view taken along the line G—G of FIG. 14.

Figure 15:
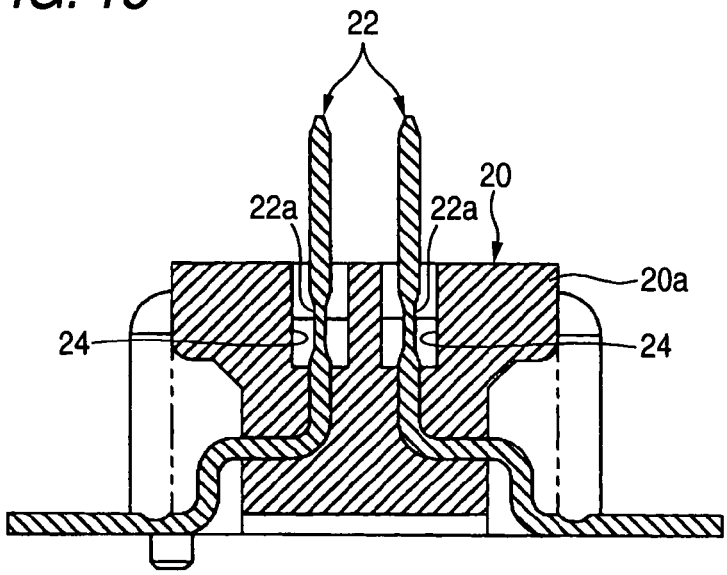
FIG. 15 is a cross-sectional view taken along the line G—G of FIG. 14.
Figure 16:
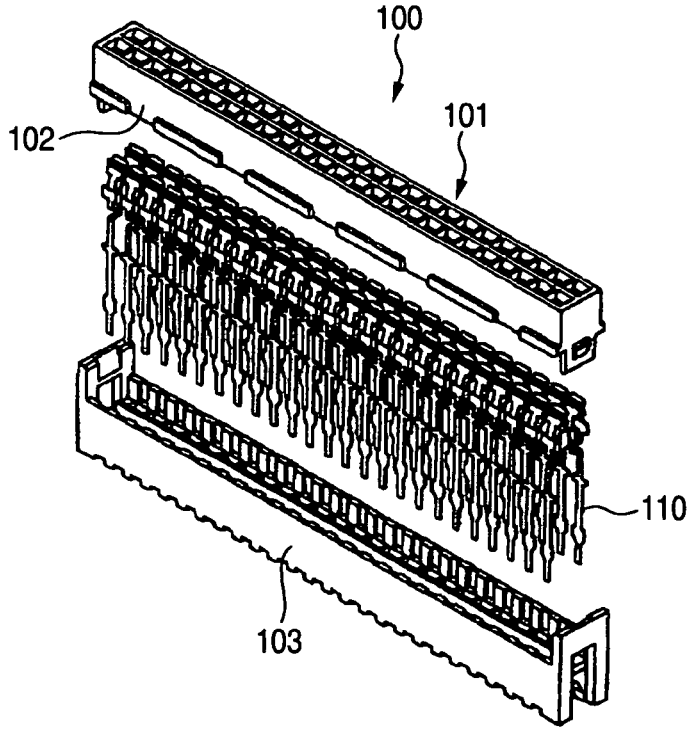
FIG. 16 is an exploded, perspective view of an electric connector disclosed in Patent Literature 1.
Figure 17:
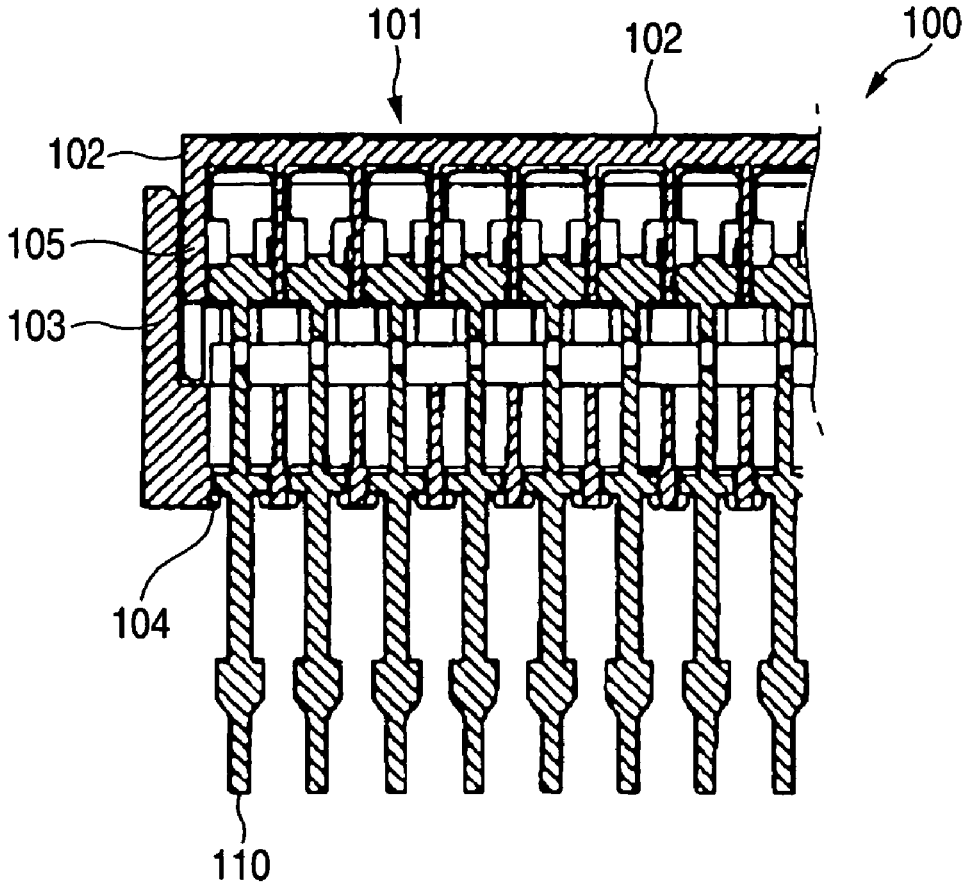
FIG. 17 is a cross-sectional view of an important portion of the electric connector of FIG. 16.
Figure 18:
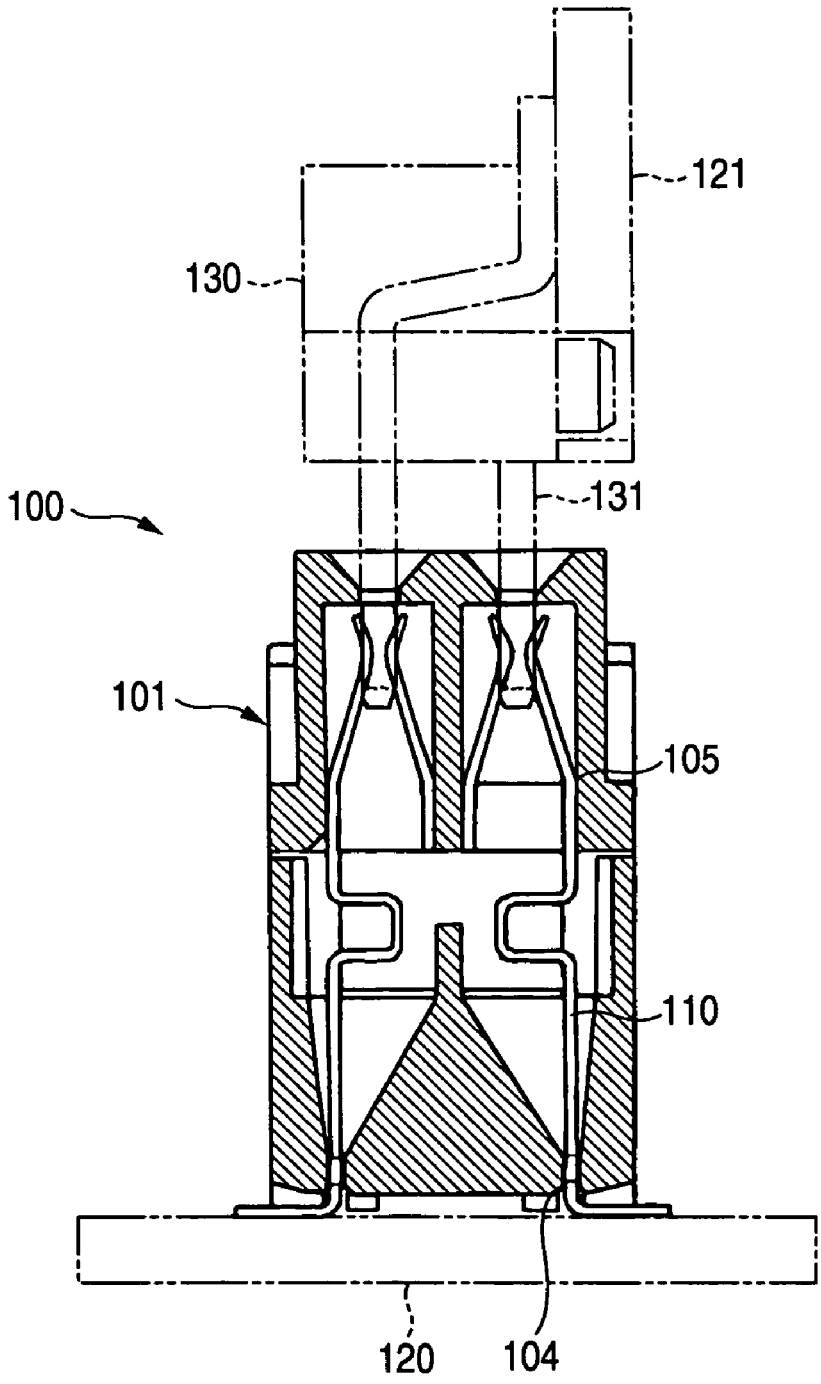
FIG. 18 is a cross-sectional view of an important portion, showing a condition in which the electric connector of FIG. 16 is mounted on a board, and is disposed in a connected condition.
Figure 19:
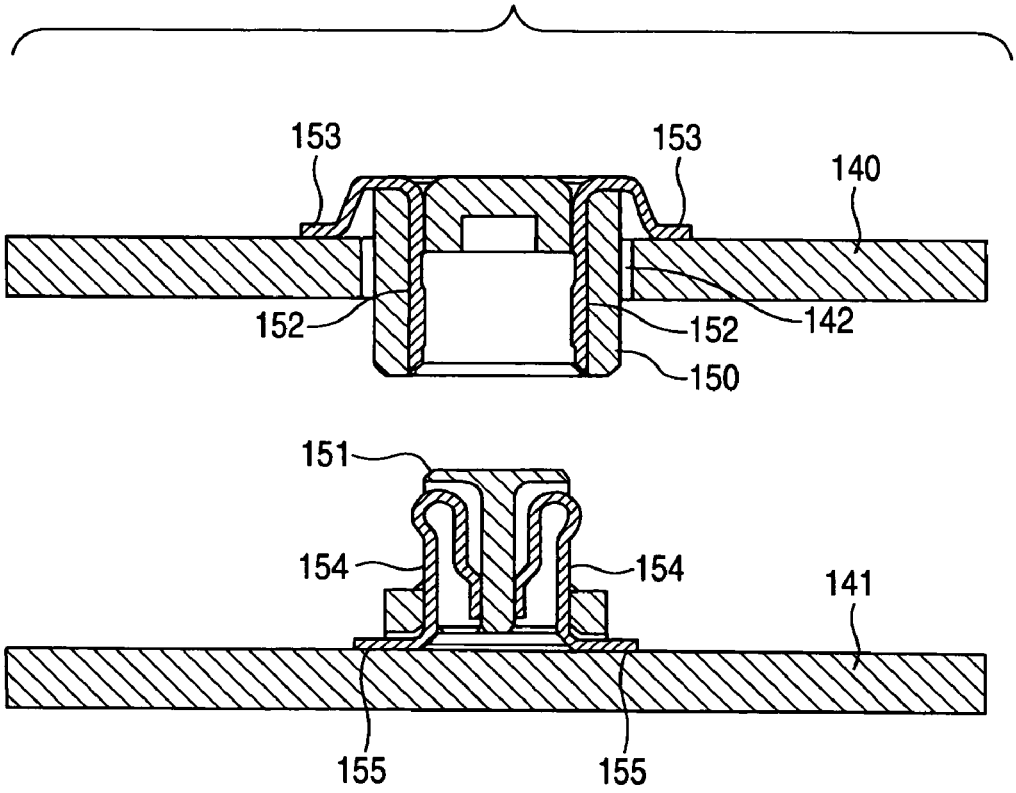
FIG. 19 is a cross-sectional view of an important portion of a printed circuit board connection structure disclosed in Patent Literature 2.

Referring to FIGS. 10 and 15, in the direct-mounting connector-fitting structure of the second embodiment, the male connector 20 is not provided with any connector fitting portion for fitting on a connector housing 21*a* of the female connector 21, and when the connectors are fitted or connected together, an upper surface of the connector housing 20*a* of the male connector 20 abuts against a lower surface of an upper printed circuit board 1. The connector housing 21*a* of the female connector 21 is fixed to an upper surface of the upper printed circuit board 1.

Namely, male terminals 22 of the male connector 20, projecting upwardly beyond the upper surface of the connector housing 20*a*, pass respectively through through holes 4 (formed through the upper printed circuit board 1), and project upwardly from the upper printed circuit board 1, and are connected respectively to corresponding female terminals 23 of the female connector 21. Deflection spaces 24 for allowing the deflection of the male terminals 22 are formed respectively in those portions of the connector housing 20*a* of the male connector 20 disposed near respectively to the proximal end portions of the male terminals 22, and also deflection spaces 25 for allowing the deflection of the male terminals 22 are formed in the through holes 4 formed through the upper printed circuit board 1.

During the fitting of the connectors, thinned portions 22*a* of the male terminals 22 are deflected within the deflection spaces 24 in the connector housing 20*a* of the male connector 20, and also those portions of the male terminals 22, disposed above the thinned portions 22*a*, are deflected within the deflection spaces 25 formed in the through holes 4 in the upper printed circuit board 1. As a result, the male terminals 22 absorb strains of the various portions of the connectors developing during the fitting of the connectors due to a positional error and a mounting error of the upper and lower printed circuit boards 1 and 2. The other construction and operation are similar to those of the first embodiment.

As described above, in the first embodiment, the thinned portions 13*b* of the male terminals 13 are deflected within the deflection spaces 15 during the fitting of the connectors. In the second embodiment, during the fitting of the connectors, the thinned portions 22*a* of the male terminals 22 are deflected within the deflection spaces 24 in the connector housing 20*a*, and also those portions of the male terminals 22, disposed above the thinned portions 22*a*, are deflected within the deflection spaces 25.

Therefore, strains of the various portions of the connectors, developing during the fitting of the connectors due to a positional error and a mounting error of the upper and lower printed circuit boards 1 and 2, can be absorbed. As a result, the positive connector-fitting performance and the enhanced durability of the connector can be secured.

The direct-mounting connector-fitting structure of the invention is suitably applied to the printed circuit board which is required to provide the positive connector-fitting performance and the enhanced durability of the connector.

What is claimed is:

1. A connector comprising:

a connector housing formed with side walls defining a cavity having a bottom portion; and a terminal provided in the connector housing and comprises a first terminal portion projecting to the cavity and a second terminal portion continued from the first terminal portion, wherein, the bottom portion is formed with a first deflection space communicating with the cavity, the first deflection space surrounds a part of the second terminal portion with a gap, at least a part of the cavity is formed by a through hole formed in a board member, and the first terminal portion passes through the through hole and is coupled with a mating terminal provided in a mating connector, so that the through hole serves as a second deflection space surrounding a part of the first terminal portion with a gap.

2. A connector according to claim 1 further comprising a board member on which the connector housing is mounted.

3. A connector according to claim 1, wherein the part of the second terminal portion includes a third terminal portion that is lower in stiffness than the first terminal portion.

4. A connector according to claim 3, wherein the third terminal portion is smaller in thickness than the first terminal portion.

5. A connector according to claim 1 further comprising the mating connector that is mounted on the board member.

* * * * *